US010640184B1

(12) United States Patent
Acosta

(10) Patent No.: US 10,640,184 B1
(45) Date of Patent: May 5, 2020

(54) INFLATABLE BOAT FENDER

(71) Applicant: Danny Acosta, Miami Beach, FL (US)

(72) Inventor: Danny Acosta, Miami Beach, FL (US)

( * ) Notice: Subject to any disclaimer, the term of this patent is extended or adjusted under 35 U.S.C. 154(b) by 0 days.

(21) Appl. No.: 16/787,243

(22) Filed: Feb. 11, 2020

(51) Int. Cl.
*B63B 59/02* (2006.01)

(52) U.S. Cl.
CPC ..... *B63B 59/02* (2013.01); *B63B 2059/025* (2013.01)

(58) Field of Classification Search
CPC ..... B63B 59/00; B63B 59/02; B63B 43/00; B63B 43/02; B63B 43/10
USPC ..... 114/219
See application file for complete search history.

(56) References Cited

U.S. PATENT DOCUMENTS 3,988,997 A * 11/1976 Fenton ..... B63B 59/02 114/219
4,924,796 A * 5/1990 Duffy ..... E02B 3/26 114/219
7,287,483 B2 * 10/2007 Thompson ..... B63B 59/02 114/219
7,509,920 B2 * 3/2009 Taylor ..... B63B 59/02 114/360

* cited by examiner

*Primary Examiner* — Lars A Olson
(74) *Attorney, Agent, or Firm* — Ruben Alcoba, Esq.

(57) ABSTRACT

An inflatable boat fender that has an internal DC powered reversible air pump. The reversible pump shall have a battery compartment wherein standard DC batteries can, be placed to power the reversible air pump. The inflatable boat fender can either be cylindrical or tear drop shaped. The air pump can be controlled manually or wirelessly. The air pump shall have an air pressure gauge that will alarm a user when the pressure is below a desired pressure.

10 Claims, 2 Drawing Sheets

INFLATABLE BOAT FENDER

TECHNICAL FIELD

The present invention pertains to an inflatable boat fender that is used to protect a boat from impact.

BACKGROUND

Boat fenders are used by boat vessel owners to prevent their vessels from impacting other bodies when the vessels are in the water.

Boat fenders are typically large in nature and pose difficulties stowing them when not in use.

Inflatable boat fenders are available in the industry, yet most require the vessel in which they are on to have air compressors and hoses to fill the inflatable boat fenders. Boat crews normally do not take the time to properly fill the inflatable boat fenders, so vessels are damaged when docking the vessels.

There are inflatable boat fenders that can be inflated manually, yet these fenders are not practical to use. The energy that a crew member has to expend to inflate a manual inflatable boat fender encourages a crew member to pretend that an inflatable boat fender does not exist on the vessel.

The present invention resolves the need of having to have an air compressor on a boat vessel to fill an inflatable boat fender. The present invention also resolves the need of having to inflate a boat fender manually.

SUMMARY

The present invention is directed to an inflatable boat fender that has an internal DC powered reversible air pump. The inflatable boat fender can either be cylindrical or tear drop shaped. The air pump can be controlled manually or wirelessly. The air pump shall have an air pressure gauge that will alarm a user when the pressure is below a desired pressure. One of the key aspects of the present invention is that the air pump has a battery compartment wherein DC batteries can, be used to power the air pump. In preferred embodiments, the air pump of the present invention shall be controlled by a microprocessor that has a transceiver that can communicate with a wireless command device.

An object of the present invention is to provide an inflatable boat fender that does not require a remote air compressor to fill.

Another object of the present invention, is to provide an inflatable boat fender that can easily be stowed on a vessel.

Still another object of the present invention is to provide an inflatable boat fender that can be operated via a wireless command device.

Yet still another object of the present invention is to provide an inflatable boat fender that does not have to be manually filled.

DRAWINGS

Figure 1:
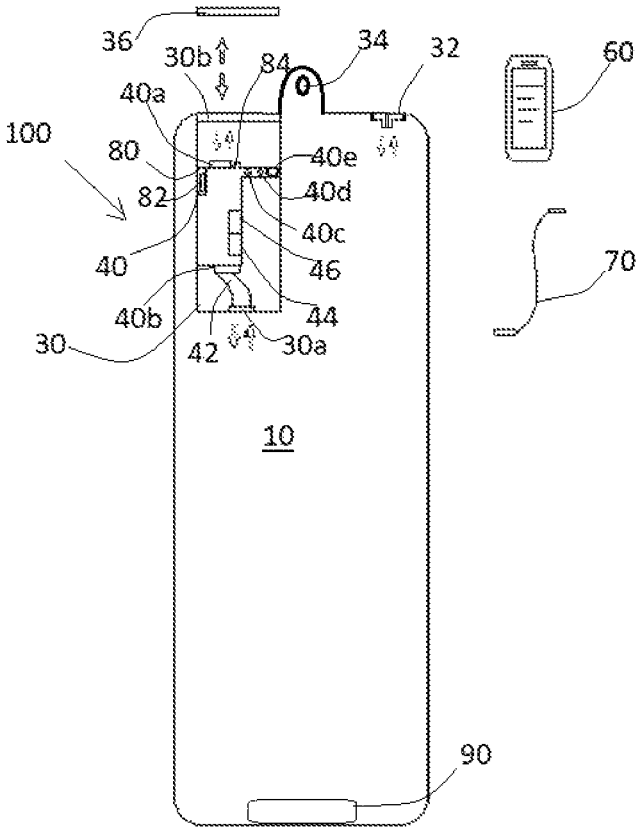
Figure 2:
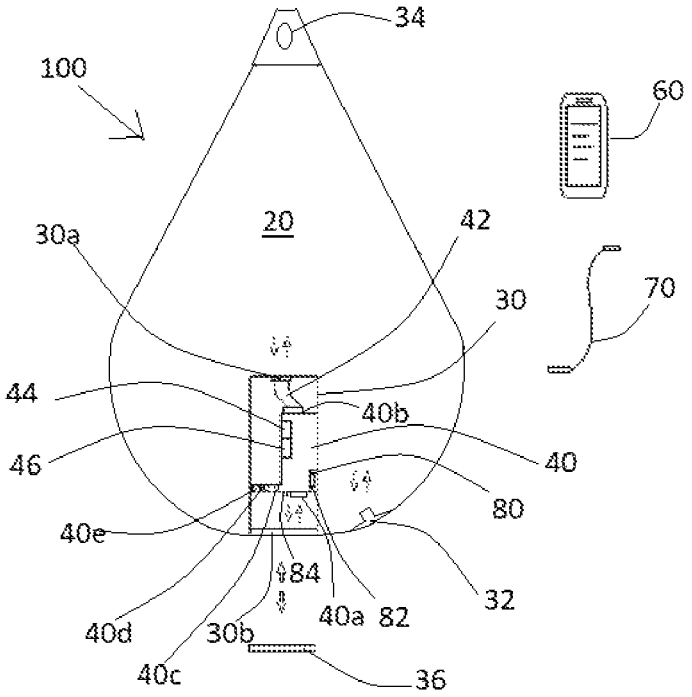

These and other features, aspects, and advantages of the present invention will become better understood with regards to the following description, appended claims, and drawings where:

FIG. 1 is a cross section view of a cylindrically shaped embodiment of the present invention; and FIG. 2 is a cross section view of a tear drop shaped embodiment of the present invention.

DESCRIPTION

Referring to FIGS. 1-2, the present invention is an inflatable boat fender 100 that is inflated using a DC power source.

The inflatable boat fender comprises of an inflatable body 10, 20, wherein the inflatable body 10, 20 defines: a sealable compartment 30 that has an aperture 30*a* that allows air to come in and out of the inflatable body 10, 20, the sealable compartment 30 defines a rim 30*b*; and a manual air input and release valve 32. A securing eye structure 34 that is attached to an exterior section of the inflatable body 10, 20. A removable lid 36 that is inserted and locked within the rim 30*b*. And, a DC powered reversible air pump 40 that is housed and secured within the sealable compartment 30, the reversible air pump 40 has a first 40*a* and a second air opening 40*b*, the second air opening 40*b* has a hose 42 that is attached to the aperture 30*a* of the sealable compartment 30, the reversible air pump 40 has an on and off button 40*c*, an inflate and deflate button 40*d*, and a pressure gauge 40*e*.

An embodiment of the present invention further comprises of a microprocessor 44 that is attached to the reversible air pump 40, the microprocessor 44 has a transceiver 46 that wirelessly connects to a wireless command device 60. The wireless command device 60 is either a computer, a cellphone, a tablet or a remote control.

In embodiments of the present invention, the reversible air pump 40 has a battery compartment 80 and at least one battery 82 that inserts within the battery compartment 80.

In some embodiments of the present invention, the reversible air pump 40 has a power plug 84 that attaches to a removable power cord 70.

In preferred embodiments of the present invention, the inflatable body 10, 20 is made of either a rubber material or of a Polyvinyl chloride material.

The inflatable body 10, 20 of the present invention is either cylindrically shaped 10 or tear drop shaped 20.

In an embodiment of the present invention, a weight 90 is attached to an inner section of the inflatable body 10. The weight 90 is used to maintain the inflatable boat fender 100 in a vertical position.

An advantage of the present invention is that it provides an inflatable boat fender that does not require a remote air compressor to fill.

Another advantage of the present invention is that it provides an inflatable boat fender that can easily be stowed on a vessel.

Still another advantage of the present invention is that it provides an inflatable boat fender that can be operated via, a wireless command device.

Yet still another advantage of the present invention is that it provides an inflatable boat, fender that does not have to be manually filled.

The embodiments of the inflatable boat fender described herein are exemplary and numerous modifications, combinations, variations, and rearrangements can be readily envisioned to achieve an equivalent result, all of which are intended to be embraced within the scope of the appended claims. Further, nothing in the above-provided discussions of the inflatable boat fender should be construed as limiting the invention to an embodiment or a combination of embodiments. The scope of the invention is defined by the appended claims.

What is claimed is:

1. An inflatable boat fender that is inflated using a DC power source, the inflatable boat fender comprises:

an inflatable body, wherein the inflatable body defines:

a sealable compartment that has an aperture that allows air to come in and out of the inflatable body, the sealable compartment defines a rim;

a manual air input and release valve; and a securing eye structure that is attached to an exterior section of the inflatable body;

a removable lid that is inserted and locked within the rim; and a DC powered reversible air pump that is housed and secured within the sealable compartment, the reversible air pump has a first and a second air opening, the second air opening has a hose that is attached to the aperture of the sealable compartment, the reversible air pump has an on and off button, an inflate and deflate button, and a pressure gauge.

2. The inflatable boat fender that is inflated using a DC power source of claim 1, the inflatable boat fender comprises of a microprocessor that is attached to the reversible air pump, the microprocessor has a transceiver that wirelessly connects to a wireless command device.

3. The inflatable boat fender that is inflated using a DC power source of claim 2, wherein the wireless command device is either a computer, a cellphone, a tablet or a remote, control.

4. The inflatable boat fender that is inflated using a DC power source of claim 3, wherein the reversible air pump has a battery compartment and at least one battery that inserts within the battery compartment.

5. The inflatable boat fender that is inflated using a DC power source of claim 4, wherein the reversible air pump has a power plug that attaches to a removable power cord.

6. The inflatable boat fender that is inflated using a DC power source of claim 5, wherein the inflatable body is made of a rubber material.

7. The inflatable boat fender that is inflated using a DC power source of claim 5, wherein the inflatable body is cylindrically shaped.

8. The inflatable boat fender that is inflated using a DC power source of claim 5, wherein the inflatable body is tear drop shaped.

9. The inflatable boat fender that is inflated using a DC power source of claim 5, wherein the inflatable body is made of a Polyvinyl chloride material.

10. The inflatable boat fender that is inflated using a DC power source of claim 5, the inflatable boat fender comprises of a weight that is attached to an inner section of the inflatable body.

* * * * *